US010310448B2

(12) United States Patent
Nagasaki

(10) Patent No.: US 10,310,448 B2
(45) Date of Patent: Jun. 4, 2019

(54) PRINTER AND COMMUNICATION SYSTEM

(71) Applicant: Brother Kogyo Kabushiki Kaisha, Nagoya-shi, Aichi-ken (JP)

(72) Inventor: Takeshi Nagasaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/141,511

(22) Filed: Sep. 25, 2018

(65) Prior Publication Data

US 2019/0101864 A1 Apr. 4, 2019

(30) Foreign Application Priority Data

Sep. 29, 2017 (JP) ..... 2017-189911

(51) Int. Cl.
*G03G 15/00* (2006.01)
*G03G 21/18* (2006.01)
*G03G 15/08* (2006.01)

(52) U.S. Cl.
CPC ..... *G03G 21/1892* (2013.01); *G03G 15/0856* (2013.01); *G03G 15/0863* (2013.01); *G03G 15/0865* (2013.01); *G03G 15/5079* (2013.01); *G03G 15/5016* (2013.01); *G03G 15/553* (2013.01); *G03G 2215/0697* (2013.01)

(58) Field of Classification Search
CPC ..... G03G 21/1892
See application file for complete search history.

(56) References Cited

U.S. PATENT DOCUMENTS

2006/0140647 A1* 6/2006 Adkins ..... G03G 21/1892 399/12
2016/0037003 A1 2/2016 Oku

FOREIGN PATENT DOCUMENTS

JP 2016-033615 A 3/2016

* cited by examiner

*Primary Examiner* — Clayton E. LaBalle
*Assistant Examiner* — Jas A Sanghera
(74) *Attorney, Agent, or Firm* — Banner & Witcoff, Ltd.

(57) ABSTRACT

In a case where a new consumable item is determined to be installed in a printer as a replacement for the current consumable item based on the related information, the printer receives, from the server, a first code assigned to a first consumable item to be installed in the printer. The printer obtains, from the second consumable item, a second code associated with a second consumable item installed in the printer as a replacement for the current consumable item. The printer determines whether the first code corresponds to the second code. The printer provides a notification indicating whether the second consumable item was determined to replace the current consumable item based on whether the first code corresponds to the second code.

16 Claims, 6 Drawing Sheets

342

| USER NAME | SERIAL NUMBER | MODEL NAME | ACCESS TOKEN | HISTORY INFORMATION | SHIPMENT INFORMATION | |
|---|---|---|---|---|---|---|
| UN | SN2 | MN | AT2 | HI2 | CN2 | D2 |
| UN | SN1 | MN | AT1 | HI1 | CN1 | D1 |
| ⋮ | ⋮ | ⋮ | ⋮ | ⋮ | ⋮ | |

(SECOND ILLUSTRATIVE EMBODIMENT)

PRINTER AND COMMUNICATION SYSTEM

CROSS-REFERENCE TO RELATED APPLICATION

This application claims priority from Japanese Patent Application No. 2017-189911 filed on Sep. 29, 2017, the content of which is incorporated herein by reference in its entirety.

FIELD OF DISCLOSURE

The disclosure relates to a technique for printers in which consumable items are to be installed.

BACKGROUND

A known server performs management of toner containers sent or shipped to users of printers. The server stores identification ("ID") information that identifies a toner container shipped from a sales company to a user of a printer. As the user installs the toner container in the printer, the printer sends to the server, ID information that identifies the toner container installed in the printer. Based on inconsistency or non-matching between the ID information stored in the server and the ID information received from the printer, the server notifies the user that a toner container different from the shipped toner container has been installed in the printer.

SUMMARY

In this management technique, for example, no consideration is paid to a situation in which a user owns a plurality of printers. For example, the sales company may ship, to the user, a toner container to be installed in one of the printers, e.g., a first printer. The server stores ID information of the toner container. The user may mistakenly install the toner container in a different one of the printers, e.g., a second printer. In this case, the server may receive the ID information from the second printer. Since the ID information stored in the server matches the ID information received from the printer, the server does not provide a notification to the user. Thus, the user who owns the plurality of printers may not know that a toner container for use in a particular printer is installed in a different printer.

One or more aspects of the disclosure provide a technique of providing a user who owns a plurality of printers with such a notification that a consumable item prepared for one of the printers (e.g., a particular printer) as a replacement for its current consumable item is not intended for use in the particular printer.

One illustrative aspect of the disclosure may provide a printer comprising: a controller configured to perform steps comprising: in a case where a new consumable item is determined to be installed in the printer as a replacement for a current consumable item based on related information associated with a status of use of the current consumable item, receiving a first code from the server, the first code being assigned to a first consumable item to be installed in the printer; obtaining a second code associated with a second consumable item from the second consumable item, wherein the second consumable item is provided to replace the current consumable item; determining whether the first code corresponds to the second code; and providing a notification based on whether the first code corresponds to the second code, the notification indicating whether the second consumable item was determined to replace the current consumable item.

According to the above-described configuration, the printer may receive the first code from the server, thereby identifying the first code assigned to the first consumable item that is a replacement for a current consumable item of the printer. For example, a user of the printer may own one or more printers besides the printer, e.g., the user owns a plurality of printers. In a case where a second consumable item, which corresponds to the first consumable item, is prepared, the printer may determine that the first code received from the server and the second code obtained from the second consumable item match. As a result, the printer may determine that the second consumable item is intended for use in the printer. In contrast, for example, in a case where a second consumable item is prepared that does not correspond to the first consumable item and is not intended for use in the printer (e.g., intended for use in a different printer), the printer may determine that the first code received from the server and the second code obtained from the second consumable item do not match. As a result, the printer may determine that the second consumable item is not intended for use in the printer. In this case, the printer may notify the user that the second consumable item is not intended for use in the printer. Therefore, the user may understand that a consumable item that is not intended for use in the printer has been prepared as a replacement for a current consumable item of the printer.

Another illustrative aspect of the disclosure may provide a communication system comprising: a server; a first printer; and a second printer, wherein the server comprises a memory storing: specific user information; first printer identifying information identifying the first printer; a first code assigned to a first consumable item to be installed in the first printer; second printer identifying information identifying the second printer; and a second code assigned to a second consumable item to be installed in the second printer, wherein the memory stores the specific user information, the first printer identifying information and the first code in association with each other, and wherein the memory stores the specific user information, the second printer identifying information and the second code in association with each other, wherein the server further comprises a server-side controller configured to perform steps of: in a case where a consumable item is to be installed in the first printer as a replacement for a current consumable item installed in the first printer, receiving a code associated with the consumable item and the first printer identifying information from the first printer, the consumable item being one of the first consumable item and the second consumable item; in a case where the code and the first printer identifying information are received, specifying the first code associated with the first printer identifying information stored in the memory; determining whether the received code corresponds to the specified first code; and based on whether the received code is determined to correspond to the specified first code, sending a specific notification to the first printer, wherein the first printer comprises a printer-side controller configured to perform steps of: obtaining the code from the consumable item, the consumable item being one of the first consumable item and the second consumable item; sending, to the server, the obtained code and the first printer identifying information; and in a case where the specific notification is received from the server based on the obtained code and the first printer identifying information being sent to the server, executing a notification operation.

According to the above-described configuration, the server may store the particular user information, printer information of the respective printers, and the codes assigned to the respective consumable items to be installed in the printers, in association with each other. For example, in a case where the first consumable item is prepared for use in the first printer as a replacement for a current consumable item of the first printer, the server may receive from the first printer, the first code and the first printer information. The server may determine that the first code received from the first printer matches the first code associated with the first printer information. As a result, the server may determine that the first consumable item is intended for use in the first printer. In contrast, for example, in a case where the second consumable item (which is intended for use in the second printer) is prepared for use in the first printer as a replacement for a current consumable item of the first printer, the server may receive from the first printer, the second code and the first printer information. The server may determine that the second code received from the first printer does not match the first code associated with the first printer information. As a result, the server may determine that the second consumable item is not intended for use in the first printer and may send a predetermined notification to the first printer. Based on receiving the predetermined notification, the first printer may notify the user that the second consumable item is not intended for use in the first printer. Therefore, the user may understand that a consumable item that is not intended for use in the first printer has been prepared as a replacement for a current consumable item of the first printer.

Control methods and computer programs for implementing the printer, and computer-readable storage media storing computer programs may have novelty and utility. The server alone may have novelty and utility. Control methods and computer programs for implementing the server, and computer-readable storage media storing computer programs may also have novelty and utility.

DETAILED DESCRIPTION

Figure 1:
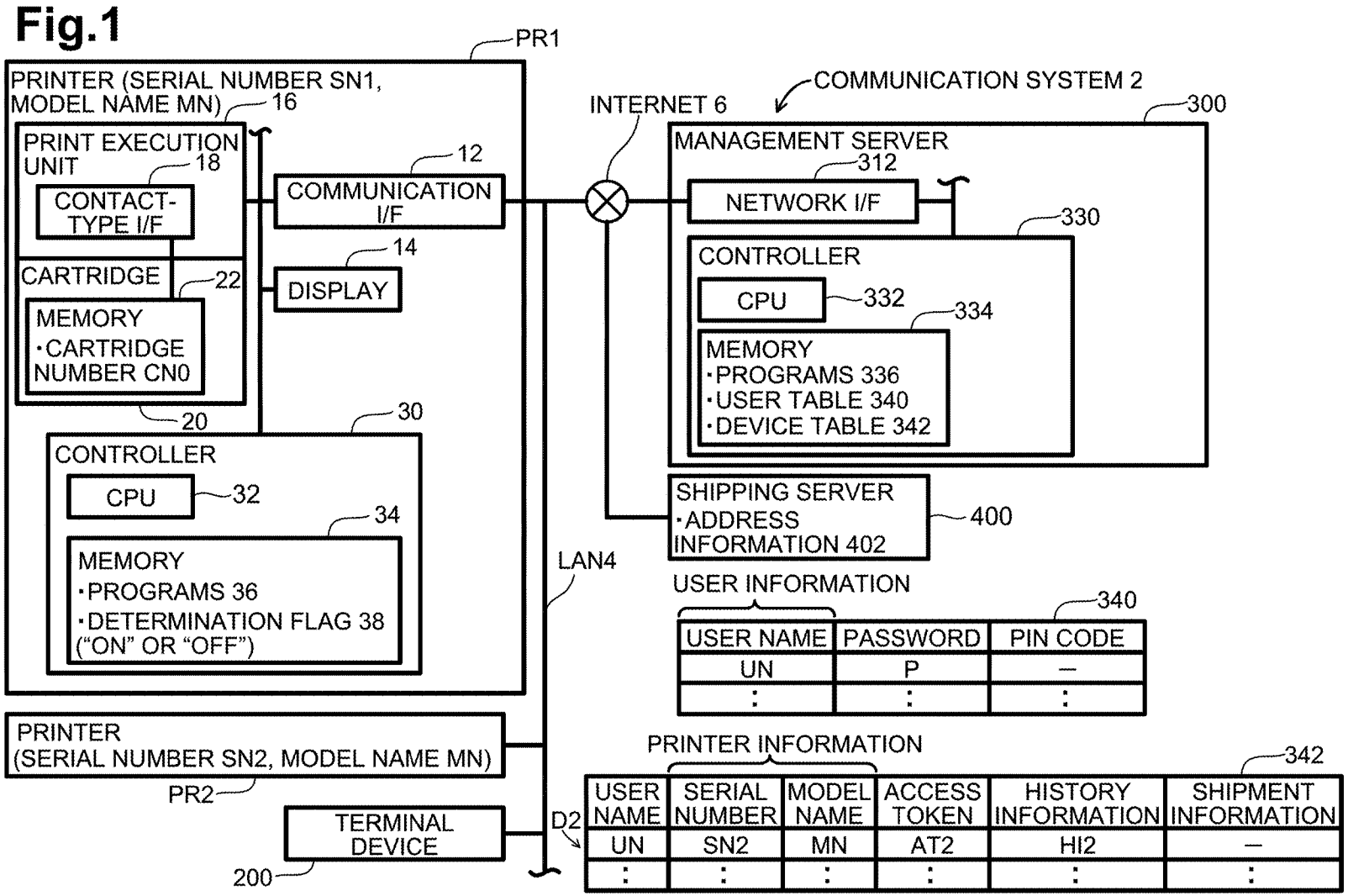
FIG. 1 is a diagram illustrating configuration of a communication system in an illustrative embodiment according to one or more aspects of the disclosure.

First Illustrative Embodiment (Configuration of Communication System 2; FIG. 1)

As depicted in FIG. 1, a communication system 2 includes a plurality of printers PR1 and PR2, a terminal device 200, a management server 300, and a shipping server 400. The printers PR1 and PR2 and the terminal device 200 are connected to a local area network ("LAN") 4. The LAN 4 may be a wired LAN or a wireless LAN. The terminal device 200 may be a computer, e.g., a desktop computer or a laptop computer, or a mobile terminal, e.g., a cellphone or a smartphone. In the illustrative embodiment, a user has the printers PR1 and PR2 and the terminal device 200, creating the LAN 4 in a company or a user's house. In other words, one user owns a plurality of printers (e.g., the printers PR1 and PR2).

The LAN 4 is connected to the Internet 6. The management server 300 and the shipping server 400 are connected to the Internet 6. Devices (e.g., the printer PR 1) connected to the LAN 4 are allowed to communicate with servers (e.g., the management server 300) connected to the Internet 6, via the LAN 4 and the Internet 6.

(Configuration of Printer PR1)

The printer PR1 is a peripheral device of, for example, the terminal device 200, and is configured to execute printing. The printer PR1 has a serial number SN1 and a model name MN. Serial numbers (e.g., the serial number SN1) are unique character strings assigned to respective printers with the model name MN, by a vendor of the printers. The printer PR1 includes a communication interface ("I/F") 12, a display 14, and a print execution unit 16, and a controller 30.

The communication I/F 12 enables the printer PR1 to connect to the LAN 4. The display 14 may include a touchscreen that functions as an operation unit.

The print execution unit 16 includes an inkjet print mechanism. In the print execution unit 16, a cartridge 20 that holds ink is installed. The print execution unit 16 is configured to execute printing using the ink in the cartridge 20. An illustrative embodiment will be described in conjunction with the cartridge 20 holding black ink. In another embodiment, the print execution unit 16 may include a laser print mechanism and may receive a cartridge holding toner.

The print execution unit 16 includes a contact-type I/F 18. The contact-type I/F 18 is configured to contact the cartridge 20 installed in the print execution unit 16, and to read out a cartridge number CN0 stored in memory 22 of the cartridge 20. Cartridge numbers (e.g., the cartridge number CN0) are unique character strings (e.g., serial numbers or consecutively-numbered reference numbers) assigned to respective cartridges 20 by a vendor of the cartridges 20.

The controller 30 includes a CPU 32 and memory 34. The CPU 32 is configured to execute various processing based on programs 36 stored in the memory 34. The memory 34 may be volatile or nonvolatile memory. The memory 34 stores therein a determination flag 38 set to "ON" or "OFF." The determination flag 38 set to "ON" represents that determination is to be executed as to whether a warning screen SC2 (to be described below) is displayed. The determination flag 38 set to "OFF" represents that determination is not to be executed as to whether the warning screen SC2 is displayed. The default setting of the determination flag 38 is "OFF".

The printer PR2 has a configuration similar to the printer PR1. The printer PR2 has a serial number SN2 and the model name MN. In short, the models of the printers PR1 and PR2 are the same, so that a cartridge installable in the printer PR1 can be installed in the printer PR2.

(Configuration of Management Server 300)

The management server 300 is configured to collect and manage information about the printers (e.g., the printer PR1). The management server 300 is connected to the Internet 6 by the vendor of the printers PR1 and PR2. In another embodiment, the management server 300 may be provided by a business operator different from the vendor.

The management server 300 includes a network I/F 312 and a controller 330. The network I/F 312 is connected to the Internet 6. The controller 330 includes a CPU 332 and memory 334. The CPU 332 is configured to execute various processing, based on programs 336 stored in the memory 334. The memory 334 may be volatile or nonvolatile memory. The memory 334 stores a user table 340 and a device table 342.

The user table 340 has one or more pieces of user information registered therein. Each piece of user information includes a user name (e.g., "UN") for identifying a user, and a password (e.g., "P") for authenticating the user. Each piece of user information may be associated with a personal identification number ("PIN") code. The PIN code may be used for registering printer information about a printer in the management server 300.

The device table 342 has one or more pieces of printer information registered therein. Each piece of printer information includes a serial number (e.g., "SN2") and a model name (e.g., "MN"). Each piece of printer information may be associated with a user name, an access token, history information, and shipment information. Those pieces of information associated with each other in the device table 342 may be hereinafter collectively referred to as "device information" (e.g., device information D2). In another embodiment, the printer information may not necessarily include a model name.

The access token is authentication information for authenticating the printer. In the illustrative embodiment, the access token is used to establish an extensible messaging and presence protocol ("XMPP") between the management server 300 and the printer RP1. The XMPP connection may allow the management server 300 connected to the Internet 6 to initiate a request and send a request to the printer PR1 through a firewall of the LAN 4. In another embodiment, a hypertext transfer protocol secure ("HTTPS") connection may be established instead of the XMPP connection.

The history information represents a history of residual amounts of ink (e.g., black ink) in the cartridge installed in a printer. The shipment information is to be stored in the device table 342 when a cartridge for a printer is shipped, and includes a cartridge number of the cartridge.

(Configuration of Shipping Server 400)

The shipping server 400 may be connected to the Internet 6 by the vendor of the printers PR1 and PR2, or by a business operator different from the vendor. The shipping server 400 stores address information 402 including the serial numbers SN1 and SN2 of the respective printers PR1 and PR2 and information indicating an address where each of the printers PR1 and PR2 is located. The shipping server 400 provides service for shipping a cartridge to an address indicated in the address information 402, based on a request from the management server 300.

Figure 2:
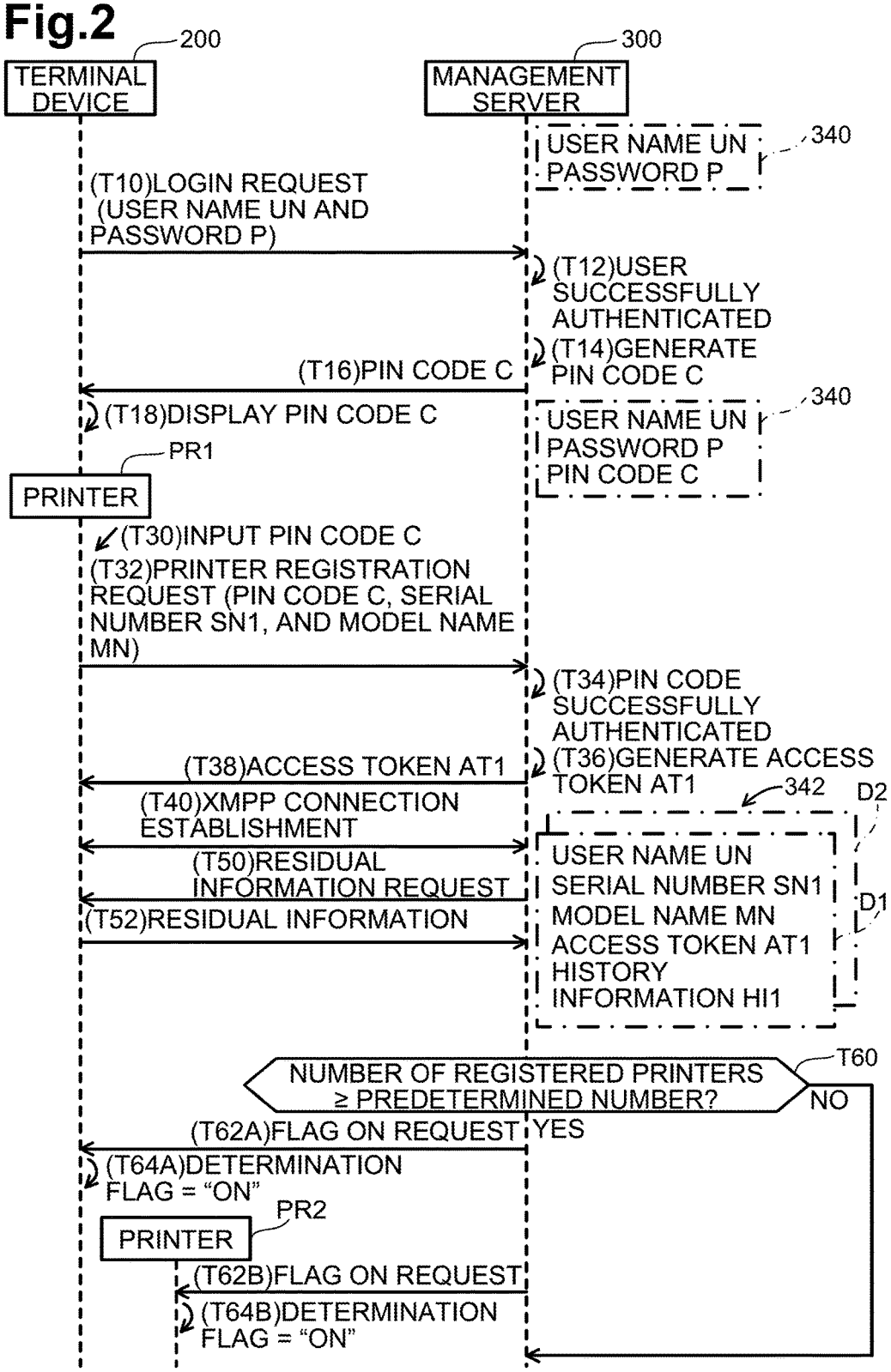
FIG. 2 is a sequence diagram illustrating printer information registration processes in an illustrative embodiment according to one or more aspects of the disclosure.

(Processes for Registering Printer Information; FIG. 2)

Referring to FIG. 2, processes or steps to be executed for registering printer information of the printer PR1 in the device table 342 of the management server 300 will now be described. Those processes may be executed by the CPU 32 of the printer PR1 and the CPU 332 of the management server 300. Instead of stating that the CPUs 32 and 332 execute the processes, the following disclosure states, for ease of understanding, that the devices (e.g., the printer PR1 and the management server 300) execute the processes.

A state prior to an execution of T10 in FIG. 2 may be referred to as an "initial state" in this disclosure. In one example, in the initial state, the user name UN and the password P may be stored in the user table 340, and the printer information of the printer PR2 may be registered in the device table 342 (refer to the device information D2 in FIG. 1).

The user may operate the terminal device 200 to designate the URL of the management server 300 and input the user name UN and the password P. Based on receiving such user operations, the terminal device 200 sends, at T10, a login request including the user name UN and the password P, to the management server 300.

Based on receiving the login request from the terminal device 200 at T10, the management server 300 determines, at T12, that a user is successfully authenticated because a combination of the user name UN and the password P included in the login request has been registered in the user table 340. As a result, the terminal device 200 is successfully logged into the management server 300. In this case, at T14, the management server 300 generates a PIN code C, and stores the PIN code C in the user table 340 in association with the user name UN and the password P. Subsequently, at T16, the management server 300 sends the PIN code C to the terminal device 200.

Based on receiving the PIN code C from the management server 300 at T16, the terminal device 200 displays, at T18, the PIN code C on its display. Accordingly, the user is able to know the PIN code C and may input, at T30, the PIN code C in the printer PR1.

Based on receiving the input of the PIN code C at T30, the printer PR1 sends, at T32, a printer registration request to the management server 300. The printer registration request is a command for requesting the management server 300 to register printer information of the printer therein. The printer registration request includes the PIN code C, the serial number SN1, and the model name MN of the printer PR1.

Based on receiving the printer registration request from the printer PR1 at T32, the management server 300 determines, at T34, that the PIN code is successfully authenticated, because the PIN code C included in the printer registration request has been stored in the user table 340. In this case, the management server 300 identifies the user name UN associated with the PIN code C (refer to step T14), from the user table 340. At T36, the management server 300 generates an access token AT1, and registers the identified user name UN, the serial number SN1 and the model name MN1 both included in the printer registration request, the access token AT1, and history information HI1 in association with each other in the device table 342. The device information D1 of the printer PR1 is thus registered in the management server 300. At this moment, the history information HI1 does not include any information. Subsequently, at T38, the management server 300 sends the access token AT1 to the printer PR1.

Based on receiving the access token AT1 from the management server 300 at T38, the printer PR1 sends, at T40, the access token AT1 to the management server 300 to establish the XMPP connection.

Subsequently, the management server 300 regularly sends a residual information request, to the printer PR1 using the XMPP connection, in every predetermined period of time (e.g., every 12 hours). The residual information request is a command for requesting a printer to send residual information indicating a residual amount of ink (e.g., black ink) in a cartridge installed in the printer. In an example depicted in FIG. 2, the management server 300 sends the residual information request to the printer PR1 at T50.

Based on receiving the residual information request from the management server 300 at T50, the printer PR1 sends, at T52, the residual information indicating an amount of ink currently remaining in the cartridge installed in the printer PR1, to the management server 300.

Based on receiving the residual information from the printer PR1 at T52, the management server 300 stores, in the device table 342, the history information HI1 representing the residual information received from the printer PRE Subsequent to registering the device information D1 at T36, the management server 300 determines, at T60, whether the number of serial numbers registered in the device table 342 in association with the user name UN is equal to or greater than a predetermined number. In the illustrative embodiment, a predetermined number is two ("2"). In another example, a predetermined number may be an integer greater than two. Step T60 may be executed prior to or subsequent to T50 and T52.

In this illustrative case, the number of serial numbers associated with the user name UN is two (e.g., the serial numbers SN1 and SN2), because the device information D2 of the printer PR2 has already been registered in the device table 342 in the initial state, and the device information D1 of the printer PR1 has been registered in the device table 342 at T36. The management server 300 determines, at T60, that the number of serial numbers registered in the device table 342 is equal to or greater than the predetermined number (T60: YES), and sends, at T62A and T62B, a flag ON request to a respective one of the printers PR1 and PR2 having the serial numbers SN1 and SN2 associated with the user name UN. The flag ON request is a command for requesting a printer to change the setting of the determination flag 38 from "OFF" to "ON". For example, if the management server 300 determines that the number of the serial numbers associated with the user name UN is less than two (T60: NO), the management server 300 does not execute T62A or T62B.

Based on receiving the flag ON request from the management server 300 at T62A, the printer PR1 changes, at T64A, the setting of the determination flag 38 from "OFF" to "ON". Based on receiving the flag ON request from the management server 300 at T62B, the printer PR2 changes, at T64B, the setting of the determination flag 38 from "OFF" to "ON". In other words, the printer PR2 stores, in its memory 34, the determination flag 38 set to "OFF" before the device information D1 of the printer PR1 is registered in the management server 300 (e.g., in the initial state in FIG. 2), while the printer PR2 stores, in its memory 34, the determination flag 38 set to "ON" after the device information D1 of the printer PR1 is registered in the management server 300 (e.g., after T36 is executed).

Figure 3:
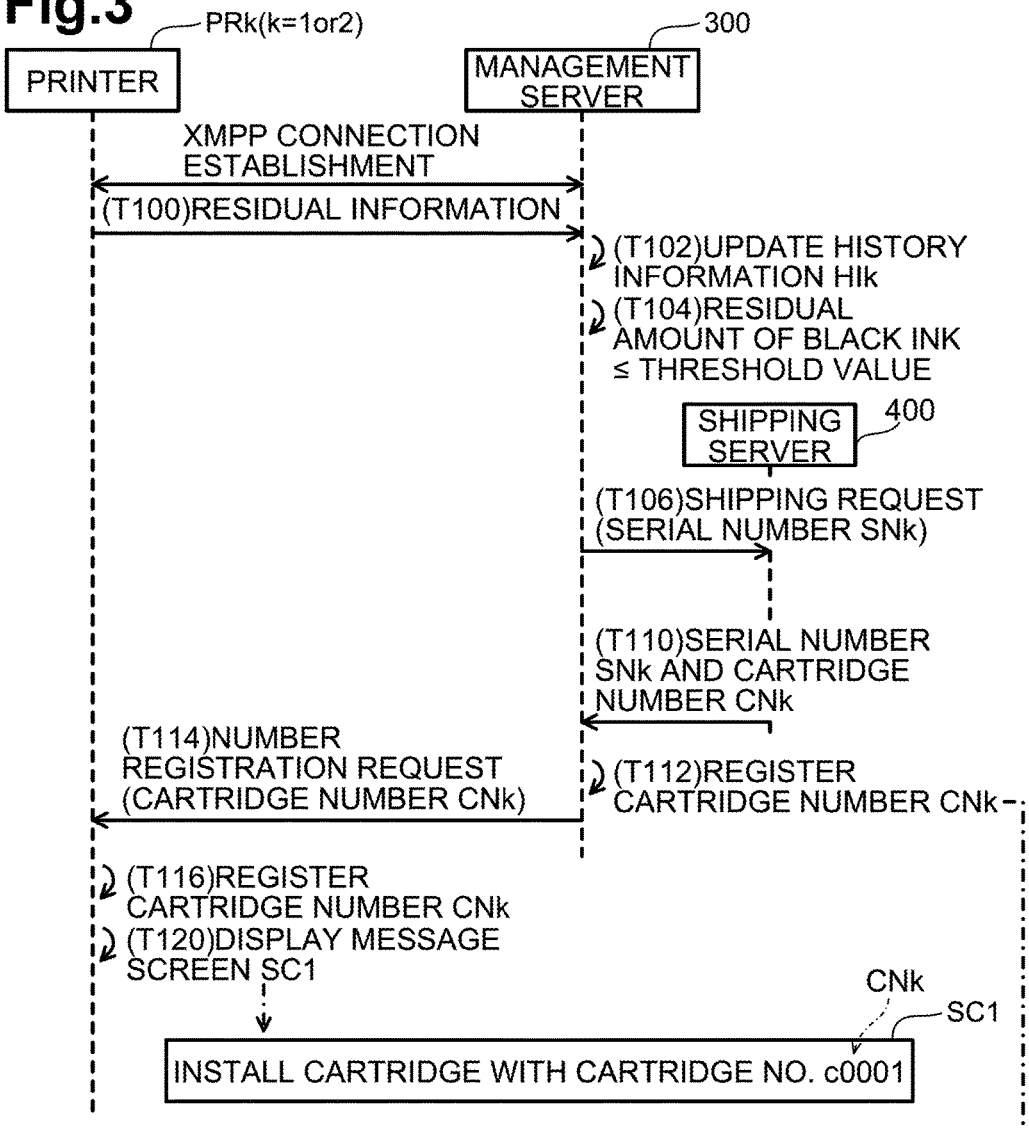
FIG. 3 is a sequence diagram illustrating cartridge shipping processes in an illustrative embodiment according to one or more aspects of the disclosure.

(Illustrative Cartridge Shipping Case; FIG. 3)

Referring to FIG. 3, an illustrative cartridge shipping case will now be described. In FIG. 3, the letter "k" following reference letters denotes "1" or "2". For example, a "printer PRk" represents the printer PR1 or the printer PR2. The management server 300 executes processes or steps depicted in FIG. 3 for each of the printers PR1 and PR2. The XMPP connection is established between the printer PRk and the management server 300 (refer to T40 in FIG. 2).

Based on receiving the residual information from the printer PRk at T100, the management server 300 stores, at T102, the history information HIk (HI1 or HI2) representing the residual information, in the device table 342. At T104, based on determining that the residual amount of black ink represented by the history information HIk is equal to or less than a threshold value (e.g., 10%), the management server 300 sends, at T106, a shipping request to the shipping server 400. The shipping request is a command for requesting the shipping server 400 to ship a new cartridge to be installed or for use in the printer PRk. The shipping request includes the serial number SNk (e.g., SN1 or SN2) of the printer PRk.

Based on receiving the shipping request from the management server 300 at T106, the shipping server 400 determines, based on the address information 402, an address where the printer PRk identified by the serial number SNk included in the shipping request, is located. The shipping server 400 executes a process for shipping a new cartridge to the address (e.g., notifying an operator that a cartridge is to be shipped). The server 400 may receive an operator's input of a cartridge number CNk (e.g., CN1 or CN2) of a new cartridge to be shipped by the operator. For example, a packaging of the new cartridge may include a bar code representing the cartridge number CNk. The operator may input the cartridge number CNk by reading the cartridge number CNk from the bar code using a reading device capable of communicating with the shipping server 400. Through the reading device, the shipping server 400 may obtain the cartridge number CNk. Alternatively, for example, the operator may input the cartridge number CNk indicated on the packaging of the cartridge by typing the cartridge number CNk into a portable terminal capable of communicating with the shipping server 400. Through the portable terminal, the shipping server 400 may obtain the cartridge number CNk. At T110, the shipping server 400 sends the serial number SNk and the obtained cartridge number CNk to the management server 300.

Based on receiving the serial number SNk and the cartridge number CNk from the shipping server 400 at T110, the management server 300 registers, at T112, shipment information representing the cartridge number CNk, in the device table 342 in association with the serial number SNk. With this configuration, for example, in a case where the residual amount of ink in the cartridge installed in the printer PR1 is reduced to a predetermined amount, the management server 300 registers shipment information representing the cartridge number CN1 in the device table 342, in association with the serial number SN1. Similarly, for example, in a case where the residual amount of ink in the cartridge installed in the printer PR2 is reduced to a predetermined amount, the management server 300 registers shipment information representing the cartridge number CN2 in the device table 342, in association with the serial number SN2.

At T114, the management server 300 sends a number registration request to the printer PRk using the XMPP connection. The number registration request includes the cartridge number CNk registered in the device table 342, and is a command for requesting the printer PRk to register the cartridge number CNk in the memory 34.

Based on receiving the number registration request from the management server 300 at T114, the printer PRk registers, at T116, the cartridge number CNk included in the number registration request, in the memory 34. Subsequently, at T120, the printer PRk causes the display 14 to display a message screen SC1. The message screen SC1 includes a message that indicates a cartridge with the cartridge number CNk, which is included in the number registration request, should be installed. This configuration may enable the user to understand that the cartridge having the cartridge number CNk is to be installed in the printer PRk.

Figure 4:
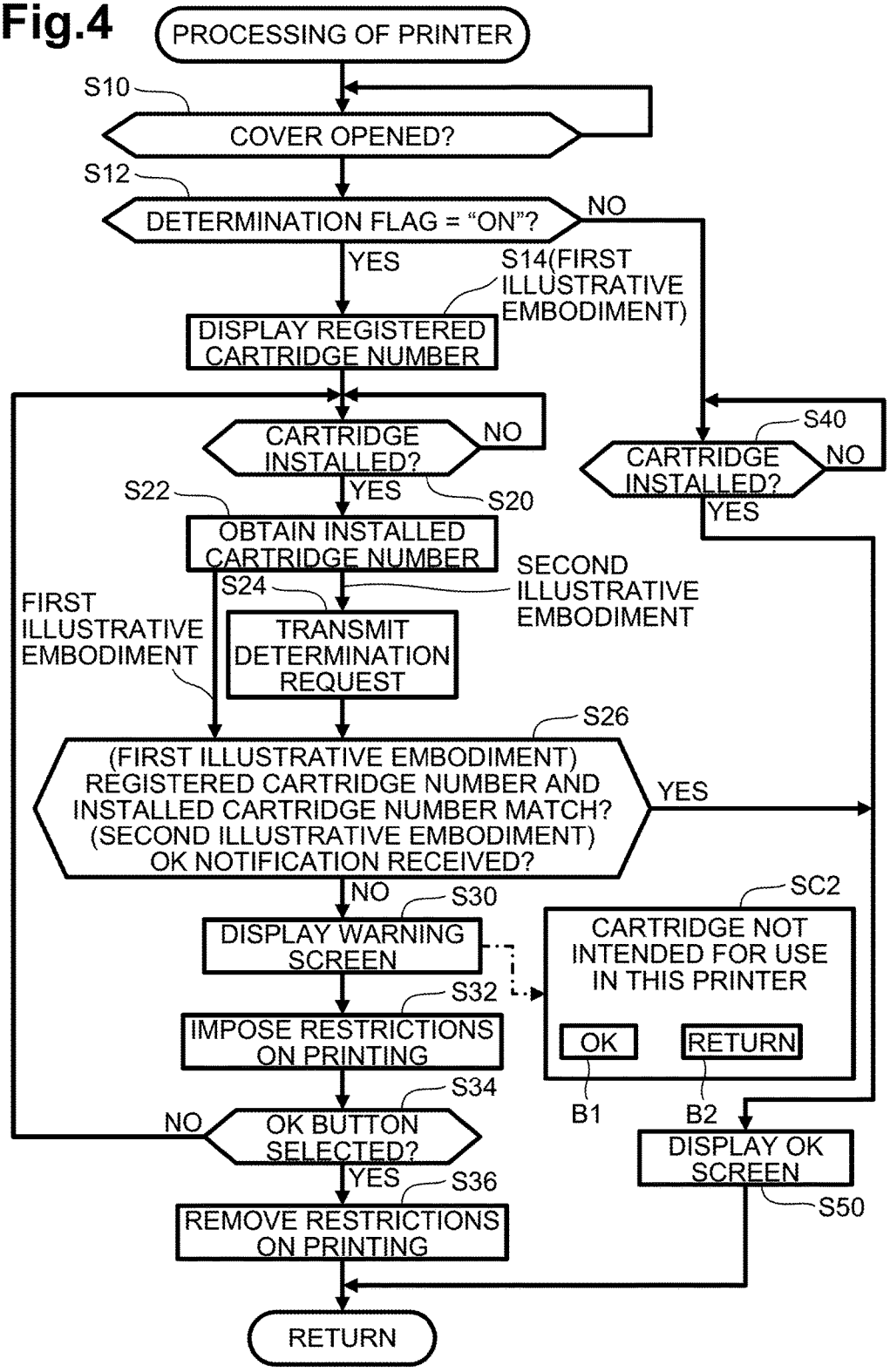
FIG. 4 is a flowchart illustrating steps to be executed by a printer of the communication system in an illustrative embodiment according to one or more aspects of the disclosure.

(Processing of Printer PR1; FIG. 4)

Referring to FIG. 4, processes or steps to be executed by the printer PR1 for installation of a new cartridge will now be described. Turning the printer PR1 on may trigger the processes in FIG. 4 to start.

At S10, the CPU 32 monitors whether a cover that covers the print execution unit 16 of the printer PR1 is open. If the CPU 32 determines that the cover is open (S10: YES), flow proceeds to S12.

At S12, the CPU 32 determines whether the determination flag 38 in the memory 34 is "ON". If the CPU 32 determines that the determination flag 38 is "ON" (S12: YES), flow proceeds to S14. If the CPU 32 determines that the determination flag 38 is "OFF" (S12: NO), flow proceeds to S40.

At S40, the CPU 32 monitors whether the cartridge 20 that has been currently installed in the print execution unit 16 is replaced with a new cartridge. If the CPU 32 determines that a new cartridge has been installed (S40: YES), flow proceeds to S50 and the CPU 32 does not execute steps S22-S36. Those steps S22-S36 will be described in detail below.

At S50, the CPU 32 causes the display 14 to display an "OK" screen, thereby notifying the user that a cartridge has been installed. Subsequent to S50, flow returns to S10.

At S14, the CPU 32 causes the display 14 to display the cartridge number (refer to T120 in FIG. 3) that is received from the management server 300 and registered in the memory 34 (refer to T116 in FIG. 3). The cartridge number registered in the memory 34 may be herein referred to as the "registered cartridge number". This configuration may allow the user to check, prior to the installation of a new cartridge in the printer PR1, whether the new cartridge is intended for use in the printer PR1.

At S20, the CPU 32 monitors whether the cartridge 20 that has been currently installed in the print execution unit 16 is replaced with a new cartridge. If the CPU 32 determines that a new cartridge has been installed (S20: YES), flow proceeds to S22.

At S22, the CPU 32 obtains the cartridge number of the new cartridge installed in the print execution unit 16, through the contact-type I/F 18 that has read the cartridge number from the memory of the new cartridge. The cartridge number of the cartridge installed in the print execution unit 16 may be hereinafter referred to as the "installed cartridge number". This configuration may enable the printer PR1 to understand the cartridge number of the new cartridge installed in the print execution unit 16.

At S26, the CPU 32 determines whether the registered cartridge number and the installed cartridge number match. If the CPU 32 determines that the registered cartridge number and the installed cartridge number match (S26: YES), flow proceeds to S50. If the CPU 32 determines that the registered cartridge number and the installed cartridge number do not match (S26: NO), flow proceeds to S30.

At S30, the CPU 32 causes the display 14 to display the warning screen SC2, thereby providing the user with such a warning or notification that a cartridge that is not intended for use in the printer PR1 has been installed. The warning screen SC2 includes an OK button B1 and a RETURN button B2. The OK button B1 may be selected by a user who desires the execution of printing using the ink in the installed cartridge. The RETURN button B2 may be selected by a user who desires cartridge reinstallation or replacement.

At S32, the CPU 32 imposes restrictions on printing by the print execution unit 16. In one example, the CPU 32 may control the print execution unit 16 not to execute printing based on a print instruction received from, for example, the terminal device 200. In other words, the CPU 32 may not allow for printing using ink in a cartridge installed in the printer PR1 if the cartridge is not intended for use in the printer PR1. In another embodiment, the CPU 32 may allow for printing of a particular image using ink in a cartridge installed in the printer PR1 even if the cartridge is not intended for use in the printer PR1, but not allow for printing other images than the particular image. A particular image may be, for example, an image including a cartridge number (e.g., a registered cartridge number) of a cartridge that is intended for use in the printer PR1, or an image to be printed for a test printing.

At S34, the CPU 32 determines whether the OK button B1 in the warning screen SC2 is selected. If the CPU 32 determines that the OK button B1 is selected (S34: YES), the CPU 32 removes, at S36, the restrictions on printing imposed at S34. In one example, the CPU 32 allows the print execution unit 16 to execute printing, based on a print instruction received from, for example, the terminal device 200. Upon completion of S36, flow returns to S10.

If the CPU 32 determines that the RETURN button B2 in the warning screen SC2 is selected (S34: NO), flow returns to S20 in which the CPU 32 monitors and determines whether a new cartridge has been installed. If the CPU 32 determines that a new cartridge has been installed (S20: YES) and the registered cartridge number and the installed cartridge number match (S26: YES), the CPU 32 causes, at S50, the display 14 to display the "OK" screen. Subsequently, the CPU 32 removes the restrictions on printing imposed at S34, although such step subsequent to S50 is omitted in FIG. 4.

Figure 5:
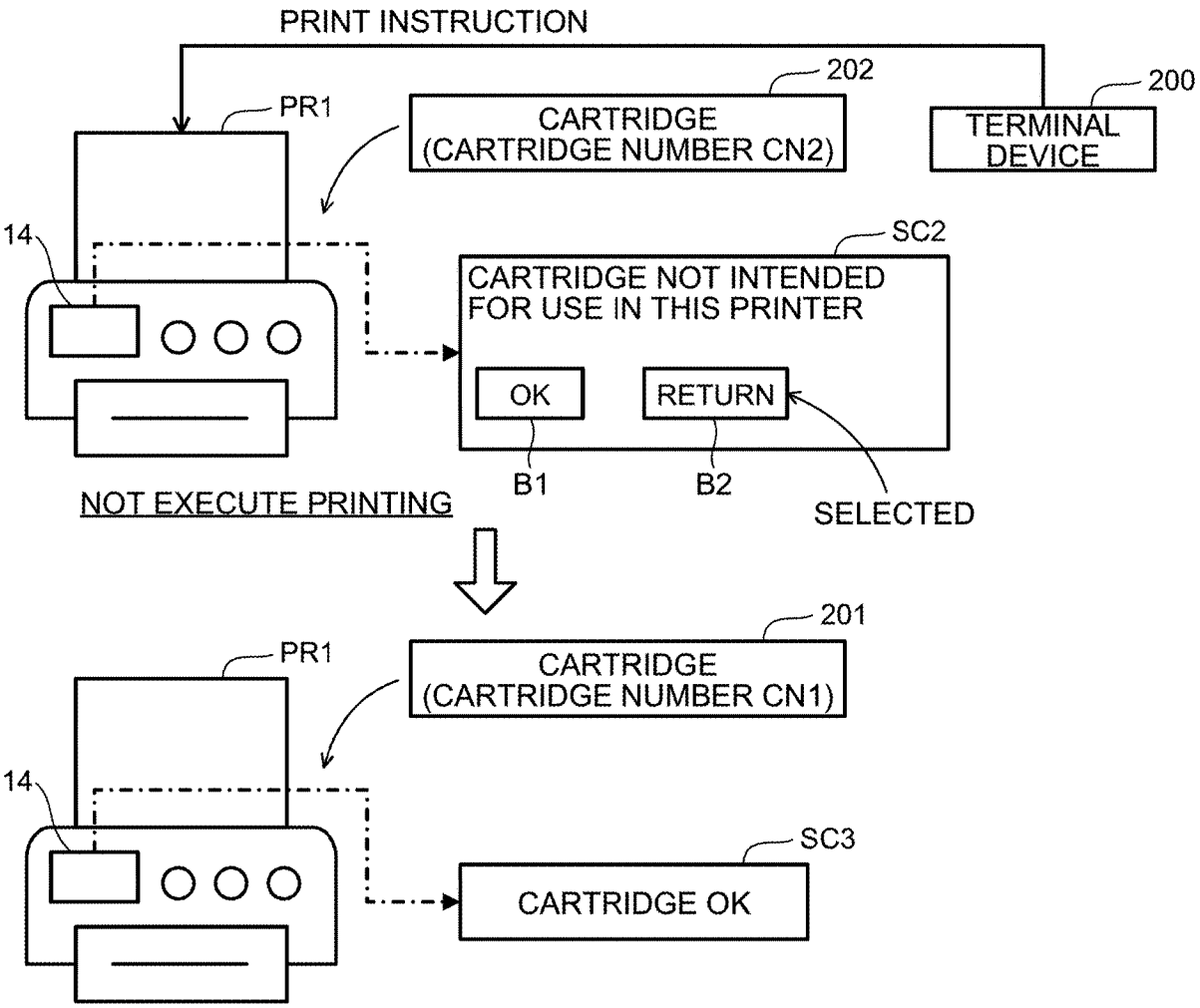
FIG. 5 is a diagram conceptually illustrating a specific case in which steps in FIG. 4 are applied.

(Example of Specific Case; FIG. 5)

Referring to FIG. 5, an example of a specific case to which steps in FIG. 4 are applied will now be described, together with effects of the illustrative embodiment. As described above, the user identified by the user name UN has the printers PR1 and PR2. In an example of the specific case, a new cartridge 201 intended for use in the printer PR1 and a new cartridge 202 intended for use in the printer PR2 are shipped to the user around the same time, by the service of the shipping server 400. The printer PR1 has already received the cartridge number CN1 of the cartridge 201 from the management server 300 and has already registered the cartridge number CN1 in the memory 34 (T114 and T116 in FIG. 3). If the cartridge 202 intended for use in the printer PR2 is mistakenly installed in the printer PR1, the printer PR1 determines that the registered cartridge number CN1 and the installed cartridge number CN2 do not match (S26 in FIG. 4: NO), and causes the display 14 to display the warning screen SC2 (S30). This configuration may enable the user to know that a consumable item that is not intended for use in the printer PR1 has been installed in the printer PR1.

In this example, the user selects the RETURN button B2 in the warning screen SC2 and replaces the cartridge 202 installed in the printer PR1 with the cartridge 201, which is intended for use in the printer PR1. Subsequently, the printer PR1 determines that the registered cartridge number CN1 and the installed cartridge number CN1 match (S26: YES), and causes the display 14 to display an "OK" screen SC3 (S50). This configuration may prevent the printer PR1 from executing printing using the ink in the cartridge 202 if the cartridge 202 is mistakenly installed in the printer PR1.

In such a case as depicted in FIG. 5 where a user owns a plurality of printers PR1 and PR2, and receives cartridges shipped for the printers PR1 and PR2 around the same time, via the management server 300 and the shipping server 400, the user may install in one of the printers PR1 and PR2, a cartridge that is not intended for use in the one of the printers PR1 and PR2. In other words, in a case where a user owns just one printer, such a situation is less likely to occur in which a cartridge that is not intended for use in the printer is installed. In the illustrative embodiment, the printer PR1 receives a flag ON request from the management server 300 (T62A in FIG. 2), based on the management server 300 registering two or more serial numbers therein in association with the user name UN. As a result, the printer PR1 changes the setting of the determination flag 38 from "OFF" to "ON" (T64A), and executes S14 and subsequent steps in FIG. 4. In contrast, if the printer PR1 does not receive a flag ON request from the management server 300, the determination flag 38 is set to "OFF", so that the printer PR1 does not execute S14 or subsequent steps. In short, in a case where a user owns just one the printer PR1, the printer PR1 does not execute S14 or subsequent steps. This configuration may reduce processing burdens on the printer PRE (Correspondence)

The printer PR1 is an example of a "printer." The management server 300 is an example of a "server." The cartridge 20 is an example of a "current consumable item". The residual information at T100 in FIG. 3 is an example of "related information". The cartridge 201 in FIG. 5 is an example of a "first consumable item." The cartridge number CN1 in FIG. 5 is an example of a "first code." The cartridge 201 or 202 is an example of a "second consumable item". The cartridge number CN1 or CN2 is an example of a "second code". Displaying the warning screen SC2 is an example of a "notification operation". The warning screen SC2 is an example of a "notification screen". Selection of the OK button B1 in the warning screen SC2 is an example of a "specific operation". The message screen SC1 to be displayed at T120 in FIG. 3 is an example of a "message screen". The flag ON request is an example of "specific information". The determination flag 38 is an example of a "flag". The "OFF" setting of the determination flag 38 is an example of a "first value". The "ON" setting of the determination flag 38 is an example of a "second value".

Second Illustrative Embodiment

Figure 6:
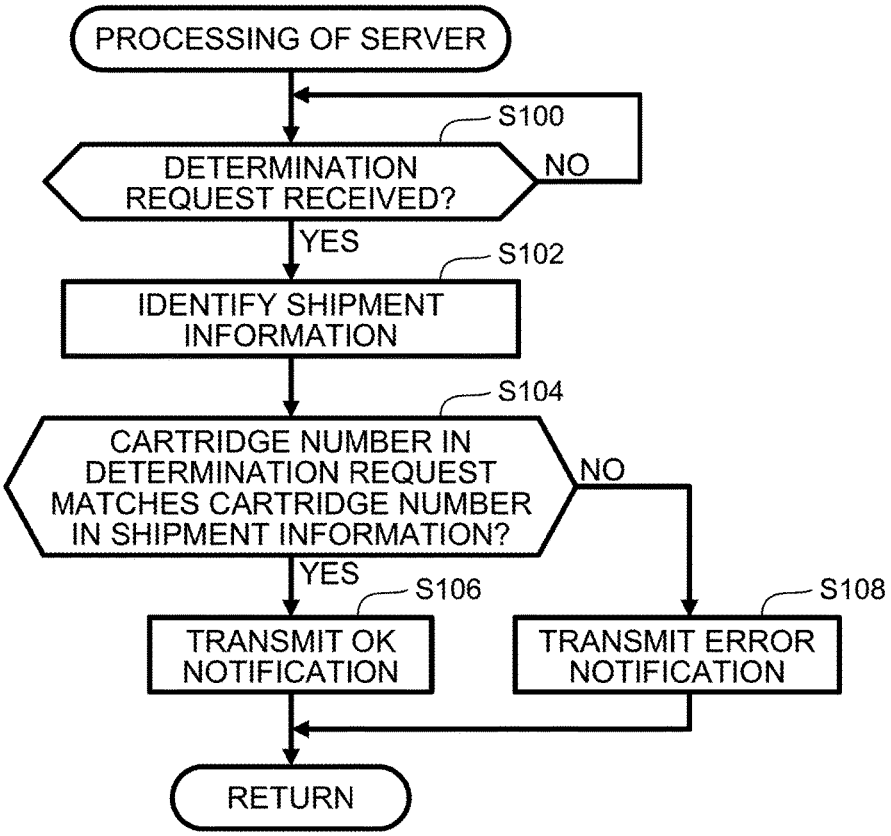
FIG. 6 is a flowchart illustrating steps to be executed by a server of the communication system in a second illustrative embodiment according to one or more aspects of the disclosure.

In the second illustrative embodiment, the printer PR1 executes processes, as depicted in FIG. 4, which are partially different from the processes of the first illustrative embodiment. Further, in the second illustrative embodiment, the management server 300 executes processes as depicted in FIG. 6.

(Processing of Printer; FIGS. 3 and 4)

In the second illustrative embodiment, steps T114 through T120 in FIG. 3 are not to be executed, and accordingly, step S14 in FIG. 4 is not to be executed. In the second illustrative embodiment, at S22 in FIG. 4, the CPU 32 obtains a cartridge number from a new cartridge installed in the printer PR1. Subsequently, at S24, the CPU 32 sends a determination request to the management server 300, via the communication I/F 12. The determination request includes the obtained cartridge number and the serial number SN1 of the printer PRE The determination request is a command for requesting the management server 300 to determine whether the cartridge represented by the cartridge number is intended for use in the printer PR1, which is represented by the serial number SN1 included in the determination request.

At S26, the CPU 32 determines whether an OK notification is received from the management server 300 as a response to the determination request at S24. The OK notification is sent from the management server 300 to the printer PR1 based on the management server 300 determining that the cartridge installed in the printer PR1 is intended for use in the printer PR1. If the CPU 32 receives the OK notification from the management server 300 (S26: YES), the CPU 32 causes, at S50, the display 14 to display the "OK" screen.

If the CPU 32 does not receive the OK notification but receives an error notification from the management server 300 (S26: NO), the CPU 32 causes, at S30, the display 14 to display the warning screen SC2. The error notification may be sent from the management server 300 to the printer PR1, based on the management server 300 determining that the cartridge installed in the printer PR1 is not intended for use in the printer PR1.

(Processing of Server; FIG. 6)

Referring to FIG. 6, processes to be executed by the CPU 332 of the management server 300 will now be described. Turning the management server 300 on may trigger the processes in FIG. 6 to start.

At S100, the CPU 332 monitors and determines whether the determination request has been received from the printer PR1 via the network I/F 312 (refer to S24 in FIG. 4). If the CPU 332 determines that the determination request has been received from the printer PR1 (S100: YES), flow proceeds to S102.

At S102, the CPU 332 identifies, from the device table 342, the shipment information associated with the serial number SN1 included in the determination request.

At S104, the CPU 332 determines whether the cartridge number included in the determination request matches the cartridge number indicated in the shipment information that is identified at S102. If the CPU 332 determines that the cartridge number included in the determination request matches the cartridge number indicated in the shipment information (e.g., the two cartridge numbers match) (S104: YES), the CPU 332 sends, at S106, the OK notification to the printer PR1. If the CPU 332 determines that the two cartridge numbers do not match (S104: NO), the CPU 332 sends, at S108, the error notification to the printer PR1. Upon completion of S106 or S108, flow returns to S100.

(Effects of Second Illustrative Embodiment)

As depicted in FIG. 3, the server 300 stores, in the device table 342, the serial number SN1 and the cartridge number CN1 (e.g., the shipment information) of the printer PR1 in association with each other, and the serial number SN2 and the cartridge number CN2 of the printer PR2 in association with each other. For example, the cartridge 202 intended for use in the printer PR2 may be mistakenly installed in the printer PR1 (refer to FIG. 5). In such case, the printer PR1 sends the determination request including the cartridge number CN2 of the cartridge 202 to the management server 300 (S24 in FIG. 4). The management server 300 determines that the cartridge number CN2 included in the determination request does not match the cartridge number CN1 associated with the serial number SN1 of the printer PR1 in the device table 342 (S104 in FIG. 6: NO). As a result, the printer PR1 receives an error notification from the management server 300 (S26: NO), and causes the display 14 to display the warning screen SC2 (S30). This configuration may enable the user to know that a consumable item that is not intended for use in the printer PR1 has been installed in the printer PR1. This configuration may prevent the printer PR1 from executing printing using the ink in the cartridge 202 if the cartridge 202 is mistakenly installed in the printer PRE (Correspondence)

The printer PR1 is an example of a "first printer". The printer PR2 is an example of a "second printer". The printer information including the serial number SN1 is an example of "first printer information". The printer information including the serial number SN2 is an example of "second printer information". The cartridge 201 is an example of a "first consumable item". The cartridge 202 is an example of a "second consumable item". The cartridge number CN1 is an example of a "first code". The cartridge number CN2 is an example of a "second code". The user information including the user name UN is an example of "particular user information". The error notification is an example of a "predetermined notification".

While aspects are described in detail with reference to specific embodiments thereof, this is merely an example, and various changes, arrangements and modifications may be made therein without departing from the spirit and scope of the disclosure.

Modifications to the illustrative embodiments are given below.

(Modification 1)

In the first illustrative embodiment, the printer PR1 receives the number registration request including the cartridge number CN1 from the management server 300 (T114 in FIG. 3). Alternatively, the printer PR1 may receive, from the management server 300, a number registration request including a code encoding the cartridge number CN1. In this case, at S26 in FIG. 4, the printer PR1 may determine whether the cartridge number CN1 decoded from the code included in the number registration request and the installed cartridge number match. In this modification, the code encoding the cartridge number CN1 is an example of the "first code". Determining whether the cartridge number CN1 decoded from the code and the installed cartridge number match is an example of "determining whether the received first code and the received second code match".

(Modification 2)

In the illustrative embodiments, the printer PR1 includes the contact-type I/F 18. Alternatively, the printer PR1 may include a non-contact type I/F (e.g., a near field communication ("NFC") I/F) configured to read a cartridge number stored in memory of a cartridge without contacting the cartridge. In this case, prior to the installation of a new cartridge in the print execution unit 16, the printer PR1 may obtain a cartridge number of the cartridge through the NFC I/F that has read the cartridge number from the cartridge. In another example, the printer PR1 may include a code reader configured to read information (e.g., a cartridge number) from a coded image, such as a one-dimensional bar code and a QR code (registered trademark). In this case, prior to installation of a new cartridge in the print execution unit 16, the printer PR1 may obtain a cartridge number through the code reader that has read the cartridge number from the coded image provided on a surface of the cartridge (or its packaging). In this modification, the "printer" does not necessarily include a contact-type interface. The "second code" may generally be obtained from the "second consumable item" when a user prepares the second consumable item.

(Modification 3)

In the illustrative embodiments, the printer PR1 displays the warning screen SC2 (S30 in FIG. 4). Alternatively, the printer PR1 may light a warning lamp or sound an audible alarm, thereby notifying a user that a cartridge that is not intended for use in the printer PR 1 has been installed in the printer PR1. In this modification, lighting a warning lamp or sounding an audible alarm is an example of the "notification operation".

(Modification 4)

The printer PR1 may not necessarily execute S32 and S36 in FIG. 4.

(Modification 5)

The printer PR1 may not necessarily display the message screen SC1 after receiving the number registration request. The printer PR1 may not necessarily execute S14 in FIG. 4.

(Modification 6)

In the illustrative embodiments, based on receiving the flag ON request from the management server 300 (T62A in FIG. 2), the printer PR1 changes the setting of the determination flag 38 from "OFF" to "ON" (T64A). Alternatively, based on receiving a user's instruction to change the setting of the determination flag 38 from "OFF" to "ON", the printer PR1 may change the setting of the determination flag 38 from "OFF" to "ON".

(Modification 7)

The printer PR1 may not necessarily store the determination flag 38, and may skip S12 in FIG. 4.

(Modification 8)

In the illustrative embodiments, based on the residual information received from the printer PR1, the management server 300 determines whether a shipping request is to be sent to the shipping server 400. Alternatively, based on determining that the residual amount of black ink is less than or equal to a threshold value, the printer PR1 may send, to the management server 300, a predetermined command for requesting the management server 300 to send a shipping request to the shipping server 400. In this case, based on receiving the predetermined command from the printer PR1, the management server 300 may determine that the shipping request is to be sent to the shipping server 400, and may send the shipping request to the shipping server 400. In this modification, the predetermined command is an example of the "related information".

(Modification 9)

In the illustrative embodiments, processes in FIGS. 2-4 and FIG. 6 are performed by the CPU 32 of the printer PR1, and/or the CPU 332 of the server 300, each of which executes respective programs 36 and 336 (e.g., software). Alternatively, at least one of the processes in FIGS. 2-4, and FIG. 6 may be executed by hardware, e.g., a logical circuit.

The technical elements described in the specification or the drawings can exhibit technical usefulness, either alone or in combination, and combinations are not limited to those described in the claims as filed. The techniques illustrated in the specification or the drawings can achieve a plurality of purposes at the same time, and achieving only one of them has technical usefulness.

What is claimed is:

1. A printer comprising:

a controller configured to perform steps comprising:

in a case where a new consumable item is determined to be installed in the printer as a replacement for a current consumable item based on related information associated with a status of use of the current consumable item, receiving a first code from a server, the first code being assigned to a first consumable item to be installed in the printer;

obtaining a second code associated with a second consumable item from the second consumable item, wherein the second consumable item is provided to replace the current consumable item;

determining whether the first code corresponds to the second code; and providing a notification based on whether the first code corresponds to the second code, the notification indicating whether the second consumable item was determined to replace the current consumable item.

2. The printer according to claim 1, wherein the obtaining the second code obtains the second code at a time where the second consumable item is installed or is being installed in the printer as a replacement for the current consumable item.

3. The printer according to claim 1, wherein the printer further comprises a contact-type interface configured to make contact with the second consumable item in the case where the second consumable item is installed in the printer, and wherein the obtaining the second code obtains the second code by reading the second code from memory of the second consumable item through the contact-type interface.

4. The printer according to claim 1, further comprising:

a display, and wherein the controller is further configured to perform:

causing the display to display a notification screen, as the notification, the notification screen including a message in a case where it is determined that the first code does not match the obtained second code.

5. The printer according to claim 1, wherein the controller is further configured to perform:

imposing a restriction on printing by the printer after the notification is executed; and removing the restriction based on a specific operation being received while the restriction on printing is imposed.

6. The printer according to claim 1, further comprising:

a display, and wherein the controller is further configured to perform:

causing the display to display a message screen in a case where the first code is received from the server, the message screen including a message indicating that the first consumable item, to which the first code is assigned, is to be installed.

7. The printer according to claim 1, wherein the controller is further configured to perform:

receiving, from the server, specific information based on printer identifying information for at least two printers, the at least two printers including the printer, wherein the controller determines whether the first code corresponds to the second code based on whether the specific information is received from the server.

8. The printer according to claim 7, wherein the controller is further configured to perform:

changing a flag from a first value to a second value based on whether the specific information is received from the server, wherein the controller determines whether the first code corresponds to the second code based on whether the flag is set to the first value or to the second value.

9. The printer according to claim 1, wherein the related information indicates a remaining life of the current consumable item.

10. The printer according to claim 1, wherein the controller is further configured to:

send, to the server, printer identifying information identifying the printer, wherein the first code received from the server is associated with the printer identifying information.

11. The printer according to claim 1, wherein the controller sends remaining life information indicating remaining life of the current consumable item as the related information, and wherein the controller receives the first code from the server based on the remaining life of the current consumable item.

12. The printer according to claim 1, wherein the controller determines whether the first code corresponds to the second code by comparing a first number represented by the first code received from the server and a second number represented by the second code obtained from the second consumable item.

13. The printer according to claim 1, wherein the controller comprises:

a processor; and a non-transitory computer readable storage medium storing instructions that, when executed by the processor, cause the printer to perform the steps.

14. A non-transitory computer readable storage medium storing instructions, the instructions, when executed by a processor of a printer, causing the printer to perform:

in a case where a new consumable item is determined to be installed in the printer as a replacement for a current consumable item based on related information associated with a status of use of the current consumable item, receiving a first code from a server, the first code being assigned to a first consumable item to be installed in the printer;

obtaining a second code associated with a second consumable item from the second consumable item, wherein the second consumable item is provided as a replacement for the current consumable item;

determining whether the first code corresponds to the second code; and providing a notification based on whether the first code corresponds to the second code, the notification indicating whether the second consumable item was determined to replace the current consumable item.

15. A communication system comprising:

a server;

a first printer; and a second printer, wherein the server comprises a memory storing:

specific user information;

first printer identifying information identifying the first printer;

a first code assigned to a first consumable item to be installed in the first printer;

second printer identifying information identifying the second printer; and a second code assigned to a second consumable item to be installed in the second printer, wherein the memory stores the specific user information, the first printer identifying information and the first code in association with each other, and wherein the memory stores the specific user information, the second printer identifying information and the second code in association with each other, wherein the server further comprises a server-side controller configured to perform steps of:

in a case where a consumable item is to be installed in the first printer as a replacement for a current consumable item installed in the first printer, receiving a code associated with the consumable item and the first printer identifying information from the first printer, the consumable item being one of the first consumable item and the second consumable item;

in a case where the code and the first printer identifying information are received, specifying the first code associated with the first printer identifying information stored in the memory;

determining whether the received code corresponds to the specified first code; and based on whether the received code is determined to correspond to the specified first code, sending a specific notification to the first printer, wherein the first printer comprises a printer-side controller configured to perform steps of:

obtaining the code from the consumable item, the consumable item being one of the first consumable item and the second consumable item;

sending, to the server, the obtained code and the first printer identifying information; and in a case where the specific notification is received from the server based on the obtained code and the first printer identifying information being sent to the server, executing a notification operation.

16. The communication system according to claim 15, wherein the server-side controller comprises:

a server-side processor; and a server-side non-transitory computer readable storage medium storing instructions that, when executed by the server-side processor, cause the first printer to perform the steps, and wherein the printer-side controller comprises:

a printer-side processor; and a printer-side non-transitory computer readable storage medium storing instructions that, when executed by the printer-side processor, cause the first printer to perform the steps.

* * * * *